US005823079A

United States Patent [19]

Liu et al.

[11] Patent Number: 5,823,079

[45] Date of Patent: Oct. 20, 1998

[54] METHOD FOR STORING A BREAD SLICING GUIDE

[75] Inventors: Simon Yiu-Chung Liu, West Bend, Wis.; Cheng Yue-Chun, Kwai Chung, Hong Kong

[73] Assignee: The West Bend Company, West Bend, Wis.

[21] Appl. No.: 840,578

[22] Filed: Apr. 21, 1997

Related U.S. Application Data

[62] Division of Ser. No. 533,523, Sep. 25, 1995, Pat. No. 5,653,154.

[51] Int. Cl.[6] ..... B26D 7/01

[52] U.S. Cl. ..... 83/13; 83/762; 83/932

[58] Field of Search ..... 83/13, 762, 761, 83/454, 466.1, 467.1, 932, 468.4, 468.5, 766

[56] References Cited

U.S. PATENT DOCUMENTS

| | | | |
|---|---|---|---|
| 280,796 | 1/1883 | Chapman . | |
| 318,694 | 5/1885 | Chapman . | |
| 662,756 | 11/1900 | Bingham . | |
| 1,053,147 | 2/1913 | Bennett . | |
| 1,072,450 | 9/1913 | Hamblin . | |
| 1,307,397 | 6/1919 | Garlock . | |
| 1,751,264 | 3/1930 | Cross et al. . | |
| 2,398,192 | 4/1946 | Scheminger, Jr. | 146/150 |
| 5,440,959 | 8/1995 | Bindon et al. | 83/100 |
| 5,598,759 | 2/1997 | Sie et al. | 83/762 |
| 5,680,803 | 10/1997 | Vizurraga et al. | 83/762 |

*Primary Examiner*—Kenneth E. Peterson
*Attorney, Agent, or Firm*—Jansson, Shupe, Bridge & Munger, Ltd.

[57] ABSTRACT

The new bread slicing guide includes a base member and a pair of guide members mounted with respect to the base member for pivoting movement about respective pivot axes. The pivot axes are under the base member so that the guide members may be folded toward and substantially against one another for storage. Each guide member is retained in a bread slicing position or a storage position by a position retention mechanism having a cavity and a raised portion generally conforming in shape to the shape of the cavity. A new method is also disclosed.

4 Claims, 6 Drawing Sheets

METHOD FOR STORING A BREAD SLICING GUIDE

This application is a division of application Ser. No. 08/533,523 filed Sep. 25, 1995 which application is now U.S. Pat. No. 5,653,154.

FIELD OF THE INVENTION

This invention relates generally to food apparatus and, more particularly, to apparatus used in connection with baked bread and the like.

BACKGROUND OF THE INVENTION

Prior to the availability of commercially-produced bread sold in grocery stores and supermarkets, householders routinely baked bread at home. Such baked bread was sliced simply by holding the loaf with one hand while cutting the desired slice with a knife. While generally effective, this method did not allow for uniformity in thickness of a particular slice or for uniformity of thickness slice to slice.

Because of these problems, various devices have been developed to aid in the cutting of bread and other bakery products. For example, a bread cutter is shown in U.S. Pat. No. 280,796 (Chapman) and comprises a base and a cutting-bed having loaf-holding and knife guiding uprights. One of the uprights is spring-biased toward the other so that loaves of differing width could be held and cut. A difficulty with the cutter of the Chapman '796 patent is that it did not fold for storage and, thus, it occupied a good deal of space on a counter or in a cupboard.

An apparent effort (of arguable success) to provide a bread cutter that occupied less storage space is shown in U.S. Pat. No. 318,694 (Chapman). Such cutter has a two part cutting bed with the parts hinged together at their inner sides. The loaf-holding uprights are firmly secured on the outer sides. While the cutter of the Chapman '694 patent allowed a degree of folding, there is insufficient range of motion to permit compact storage of the bread cutter.

Other work in the field of bread slicing guides is exemplified by U.S. Pat. No. 1,072,450 (Hamblin) which shows a bread slicer having loaf-holding uprights separately hinged along respective sides of a cutting base. The uprights are moved into the cutting position and held in place by a spring hooked across the top of the loaf of bread. As with the cutter of the Chapman '694 patent, however, this device only provides for relatively-limited rotation about the pivot axis and thus does not permit particularly compact storage. And to the likely aggravation of the user, the Hamblin slicer needed a degree of "setup" and manipulation before it could be used.

U.S. Pat. No. 2,398,192 (Scheminger) discloses a slicing board with a cutting base and two retaining barriers, one hinged along each side of the base. The barriers could be folded in on top of the cutting base and on one another. The barriers are not self-locking nor do they automatically remain in positions appropriate for bread slicing. Rather, the user must insert a support between the barriers.

With the advent of commercially-baked, pre-sliced bread and grocery stores stocking a variety of such bread, demand for bread cutters and guides declined. There was simply no long any need for them.

However, with the increased popularity of home bread making appliances, there is a renewed need for a durable device that will allow for the safe, uniform slicing of a whole loaf of bread. And the need for compact storage and ease of use remains.

While such needs persist, not all designers of bread slicing guides-have been attentive to them or, perhaps, even aware of them. For example, PRESTO® (National Presto Industries, Inc.) offers a bread-slicing system which is rigidly-constructed and apparently incapable of being folded. And such system has a rear barrier which is understood to be of one-piece construction.

An improved bread-slicing guide which conveniently folds for storage, which is light in weight, durable, substantially impervious to dishwashing soap, free of sharp edges and which automatically retains its foldable guide members in an upright or folded position would be an important advance in the art.

OBJECTS OF THE INVENTION

An object of the invention is to provide an improved bread slicing guide overcoming some of the problems and shortcomings of the prior art.

Another object of the invention is to provide an improved bread slicing guide which allows for compact storage.

Another object of the invention is to provide an improved bread slicing guide which has foldable guide members that are self supporting in the bread-slicing position.

Yet another object of the invention is to provide an improved bread slicing guide which has guide members that fold to a storage position beneath the cutting surface.

Another object of the invention is to provide an improved bread slicing guide which has guide members that fold to a side-by-side storage position.

Another object of the invention is to provide an improved bread slicing guide that is easy to clean.

Another object of the invention is to provide an improved bread slicing guide which is made of a durable dishwasher-safe material.

Still another object of the invention is to provide an improved bread slicing guide that is substantially free of sharp edges.

Another object of the invention is to provide an improved bread slicing guide which is light in weight. How these and other objects are accomplished will become apparent from the following descriptions and from the drawings.

SUMMARY OF THE INVENTION

The invention is an improvement in a guide apparatus used for slicing bread and other bakery products. Such apparatus is of the type having a flat, generally rectangular base member with a cutting surface bounded by a pair of spaced longitudinal sides. The device also has a pair of guide members mounted to the base member for pivoting movement about respective pivot axes. Such guide members each have a digitated sidewall that defines a plane.

In the improvement, the pivot axes are under the base member. This allows the guide members to be stored by folding them toward one another to a juxtaposed position beneath the base. When a guide member is in the bread slicing position, the plane defined by its sidewall is spaced from the base member cutting surface. And when a guide member is in the storage position, the plane defined by its sidewall intersects the base member cutting surface.

The axes about which the guide members pivot are oriented to intersect two support members, one at each opposed end of the base member. In use, the support members support the base member above a surface such as a counter top.

To help establish a loaf position which makes it convenient to slice such loaf, the new guide includes a barrier lateral to the base member. Before cutting a slice of bread from the loaf, such loaf is abutted against the barrier. Thereafter, slices may be removed from either end of the loaf. In a preferred embodiment, the distance between the barrier and the center line of the first slots in the guide members is substantially equal to the distance between any pair of slots which are adjacent to one another.

In a specific embodiment, there are two barriers, one attached to each guide member. When the guide members are positioned for bread slicing, the barriers are adjacent to the cutting surface of the base member and when the guide members are folded for storage, such guide members are adjacent to the lower surface of such base member.

In another aspect of the invention, each guide member includes an attachment portion intersected by a separate pivot axis. Such attachment portions are generally lateral to the base member, irrespective of whether the guide members are in bread-slicing positions or storage positions.

A convenient feature of the new bread slicing device involves a position-retention mechanism, a separate one of which retains each guide member in either the bread-slicing position or the storage position. Each such mechanism includes a cavity and a raised portion. In a highly preferred embodiment, the cavity is in the guide member and the raised portion is on the support member.

The cavity and the raised portion have the same "torque-transmitting" geometric shape which coacts between the base member and the guide member. In a specific embodiment, both the cavity and the raised portion resemble an ice hockey rink in shape in that they are generally rectangular and have rounded ends. This is because a rectangular shape only allows the guide members to be locked into positions 180° apart from each other. Of course other geometric shapes, including a diamond, could be used to lock the guides into position 180° apart from each other.

The guide member is spring-biased and when such member is in either the bread-slicing position or the storage position, the raised portion and the cavity are "nested" to one another to hold the guide member in position. And when the guide member is being pivoted between the bread slicing and storage positions, the raised portion and the cavity are spaced slightly from one another.

To "set up" a guide member at the bread slicing position or to move such member to its storage position, light force is applied to the guide member in a direction generally parallel to the pivot axis. Such force application disengages the position-retention mechanism by moving the raised portion and cavity away from one another. In a specific embodiment, the cavity (formed in the attachment portion of the guide member) is moved away from the raised portion so that such portion is out of the cavity.

Thereafter, the guide member may be rotated 180 degrees about its pivot axis to be positioned for bread slicing or storage, as the case may be. When applied force is released (as it may be after only slight rotation), the raised portion again nests in the cavity as they become properly aligned.

Further details of the invention are set forth in the following detailed description and the drawings.

DETAILED DESCRIPTION OF PREFERRED EMBODIMENTS

Figure 1:
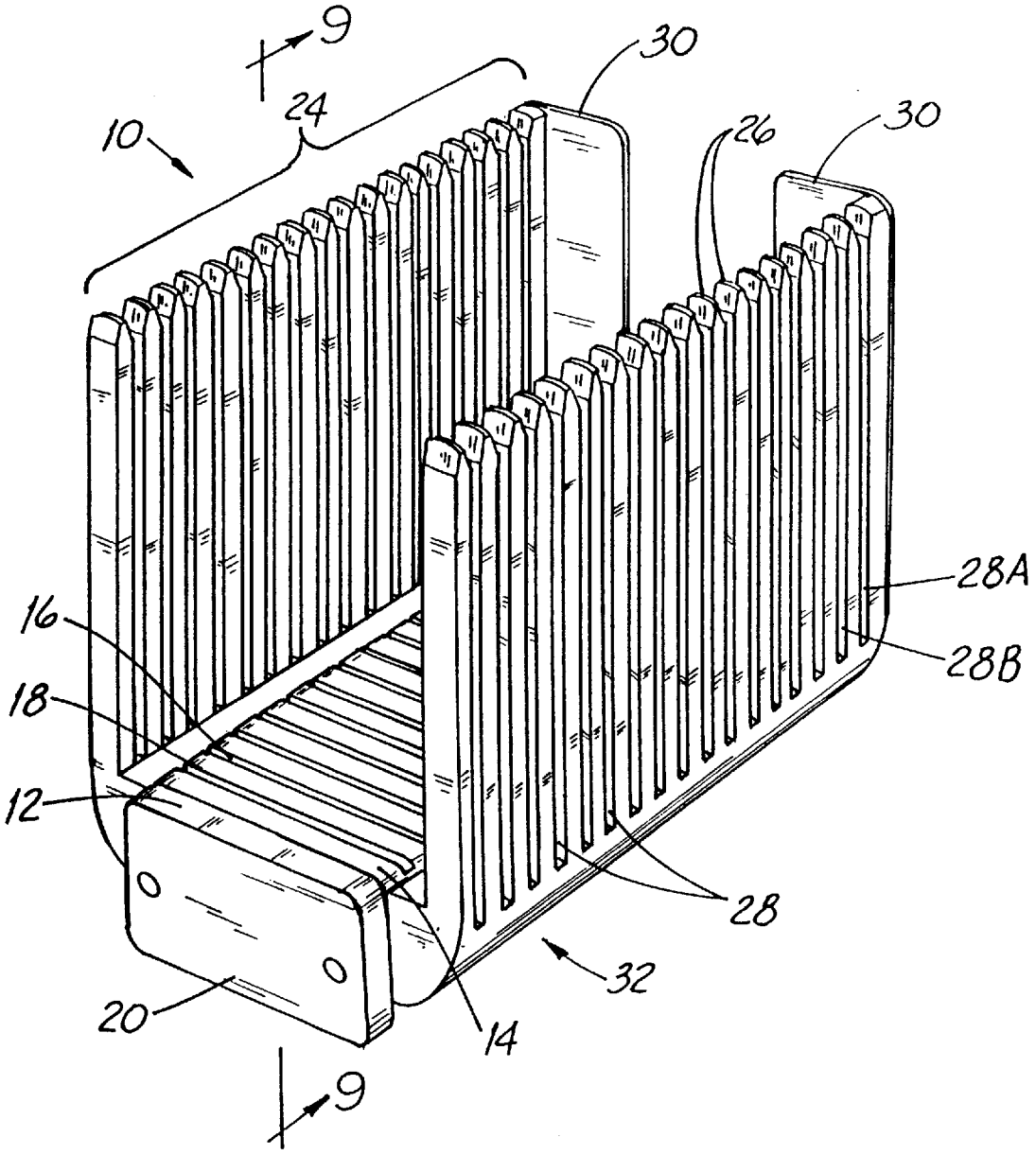
FIG. 1 is a perspective view showing the bread slicing guide with the guide members retained in the bread slicing position.
Figure 2:
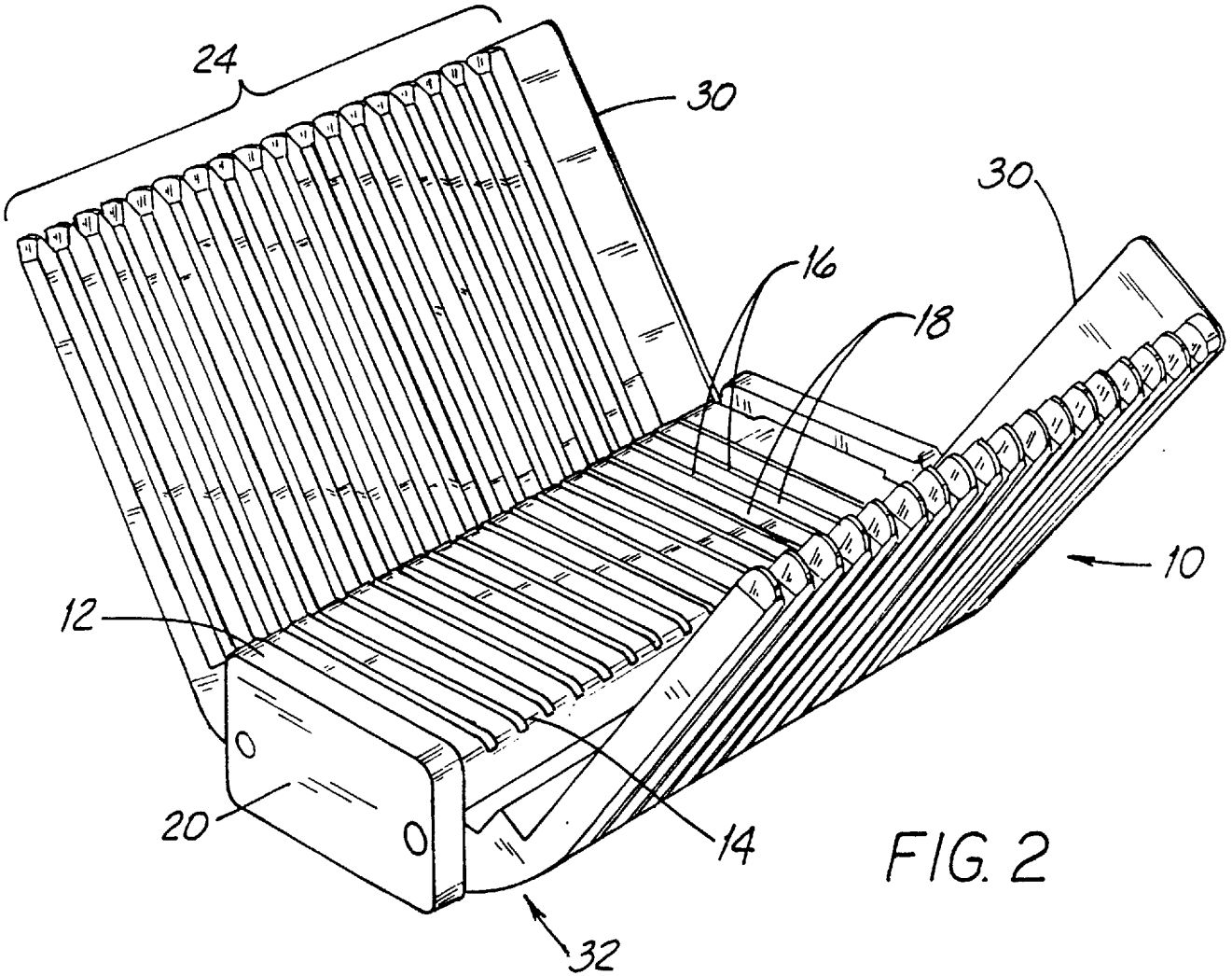
FIG. 2 is a perspective view of the guide of FIG. 1 and showing the guide members rotated away from the locked position.

Referring first to FIGS. 1 and 2, the new bread slicing guide 10 includes a flat, generally rectangular base member 12 with a cutting board 14 having alternating regularly-spaced grooves 16 and ridges 18 formed in its cutting surface. Such surface is bounded by a pair of spaced longitudinal sides and by opposed ends, each of which is generally normal to the sides. There are two "foot-like" generally-rectangularly support members 20, one member extending downwardly at each end for supporting the cutting board 14 above a work surface such as a counter top. In a highly preferred embodiment, a reinforcing rib 22 is below the cutting board 14 and connects to the board and the support members 20.

The guide also has a pair of guide members 24 mounted to the base member 12 (and, specifically, to the support members 20) for pivoting movement about respective pivot axes. Such axes are under the base member 12 and, more specifically, under the cutting board 14 and intersect the support members 20. The guide members 24 are generally L-shaped (or shaped like a reverse L, depending upon the viewing position) and each has a digitated sidewall 48 formed to have a plurality of generally-parallel guide fingers 26 having rounded distal ends. Pairs of fingers define guide slots 28 for receiving a knife blade during bread slicing. As shown in FIG. 1, each guide member 24 defines a plane.

Figure 3:
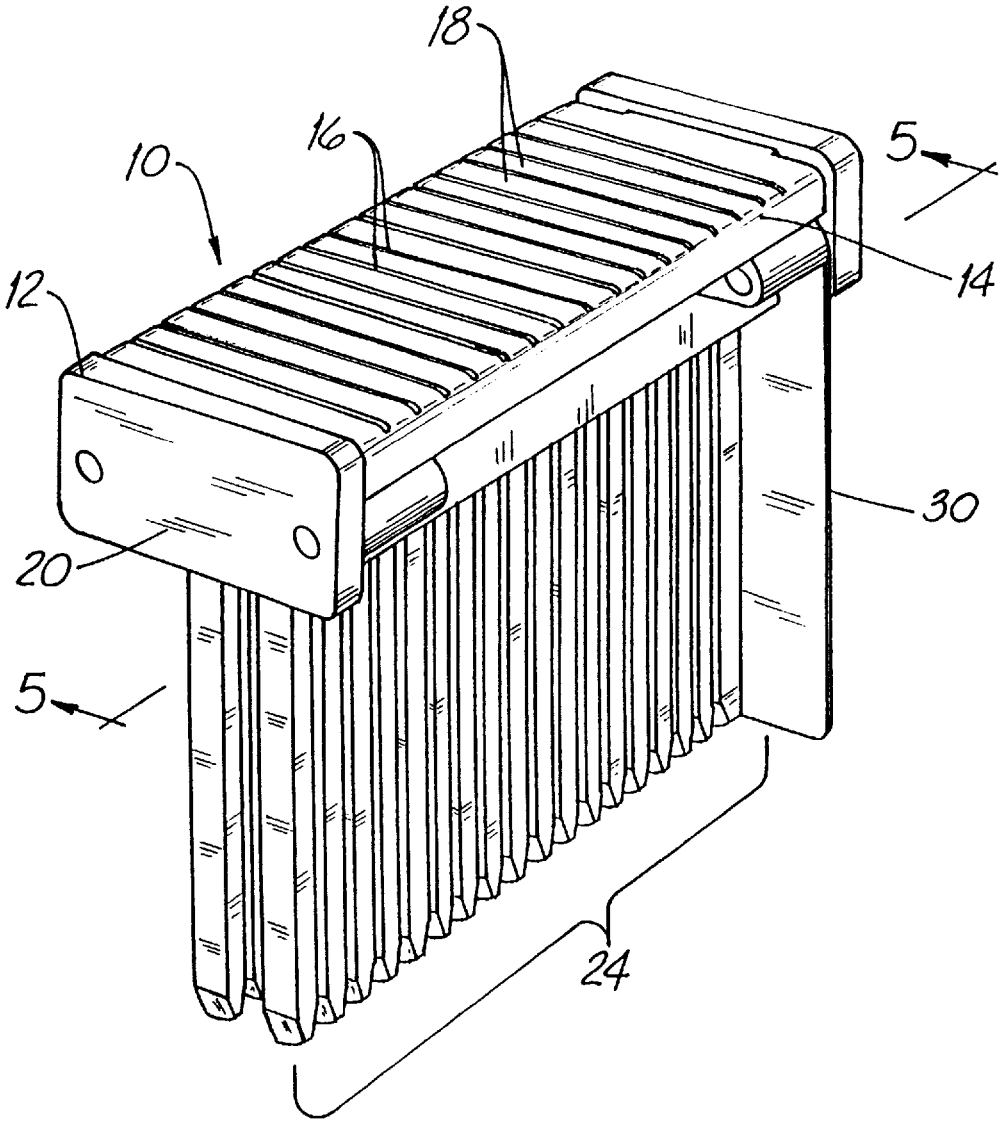
FIG. 3 is a perspective view of the bread slicing guide of FIG. 1 and showing the guide members retained into the storage position.
Figure 4:
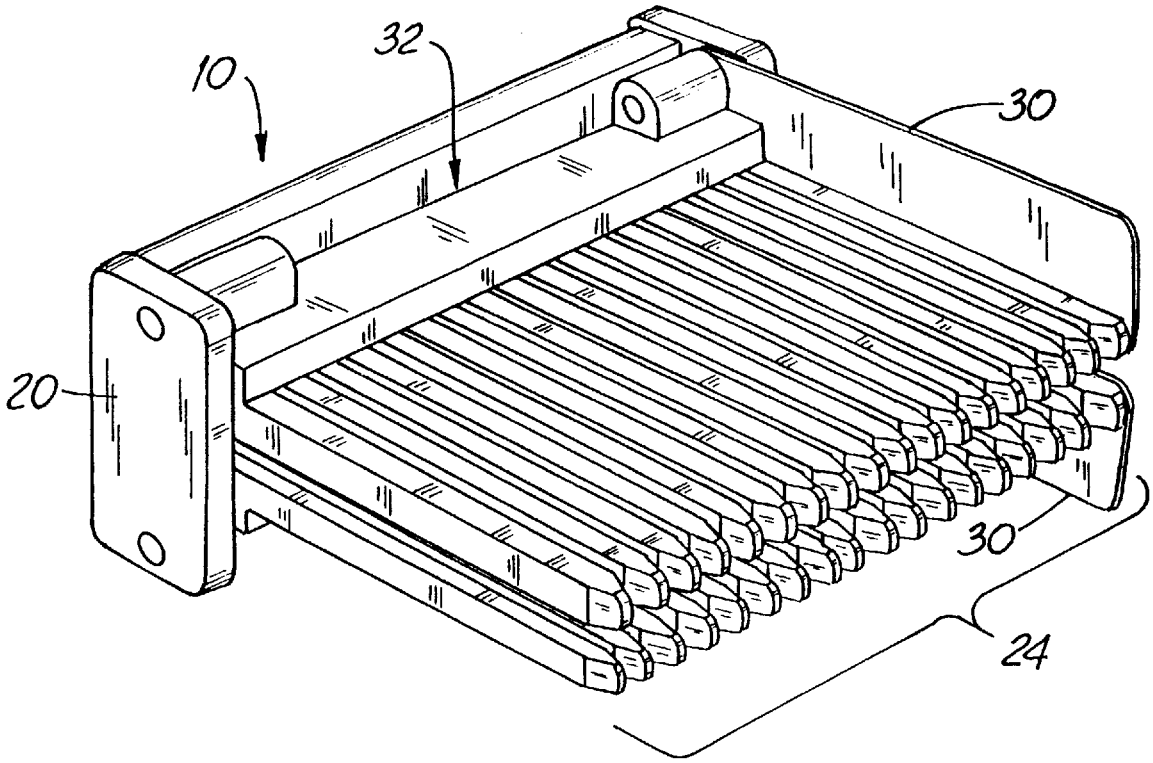
FIG. 4 is a perspective view of the bread slicing guide positioned on its side with the guide members in the storage position.

As particularly shown in FIG. 3, the aforedescribed arrangement allows the guide members 24 to be stored by folding them toward one another to a juxtaposed position beneath the base member 12. When a guide member 24 is in the bread slicing position as shown in FIG. 1, the plane defined by its sidewall 48 is spaced from the cutting surface. And as shown in FIG. 3, when a guide member is in the storage position, the plane defined by its sidewall 48 intersects such surface.

For this part of the description, it is assumed that the user of the new guide 10 cuts at least two slices from an unsliced loaf of bread. For purposes of uniformity of slice thickness, the new guide 10 includes a barrier 30 lateral to the base member 12. The distance between the barrier 30 and the center line of the first slots 28 in the guide members 24 is substantially equal to the distance between any pair of slots 28, e.g., slots 28A and 28B, which are adjacent to one another. Before cutting a slice from either end of a loaf, the loaf is preferably abutted against the barrier 30.

In a specific embodiment, there are two barriers 30, one attached to and pivotable in unison with each guide member 24. When the guide members 24 are positioned for bread slicing (as in FIG. 1), the barriers 30 are adjacent to the cutting surface of the base member 12 and when the guide members 24 are folded for storage as shown in FIG. 3, such guide members are adjacent to the lower surface of such base member 12.

More specifically, each guide member 24 includes an attachment portion 32 intersected by a separate pivot axis and extending generally normal to the plane defined by the sidewall 48 of that guide member 24. And such attachment portions 32 are generally lateral to the base member 12, irrespective of whether the guide members 24 are in bread-slicing positions or storage positions.

Figure 5:
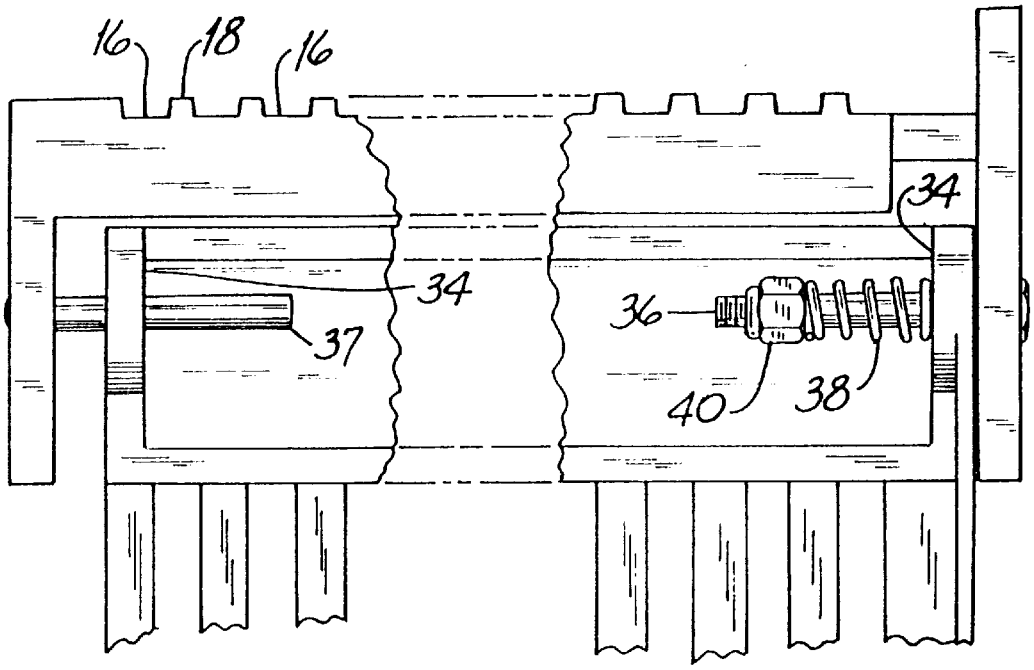
FIG. 5 is a section view taken along the viewing plane 5—5 of FIG. 3 and showing a guide member retained in the storage position by a position-retention mechanism. Parts are broken away.

As shown in FIG. 5, each attachment portion includes a pair of legs 34 engaged by respective pivot pins 36, 37. Each pin 36, 37 is fixed with respect to the support member 20 upon which it is mounted and each pin 36, 37 extends (with slight clearance) through a hole in a respective leg 34. The pin 36 has a compressed biasing spring 38 mounted thereon between the leg 34 and a spring-retaining compression nut 40. Each spring 38 biases its respective guide member 24 toward one of the support members 20 as further described below.

Figure 6:
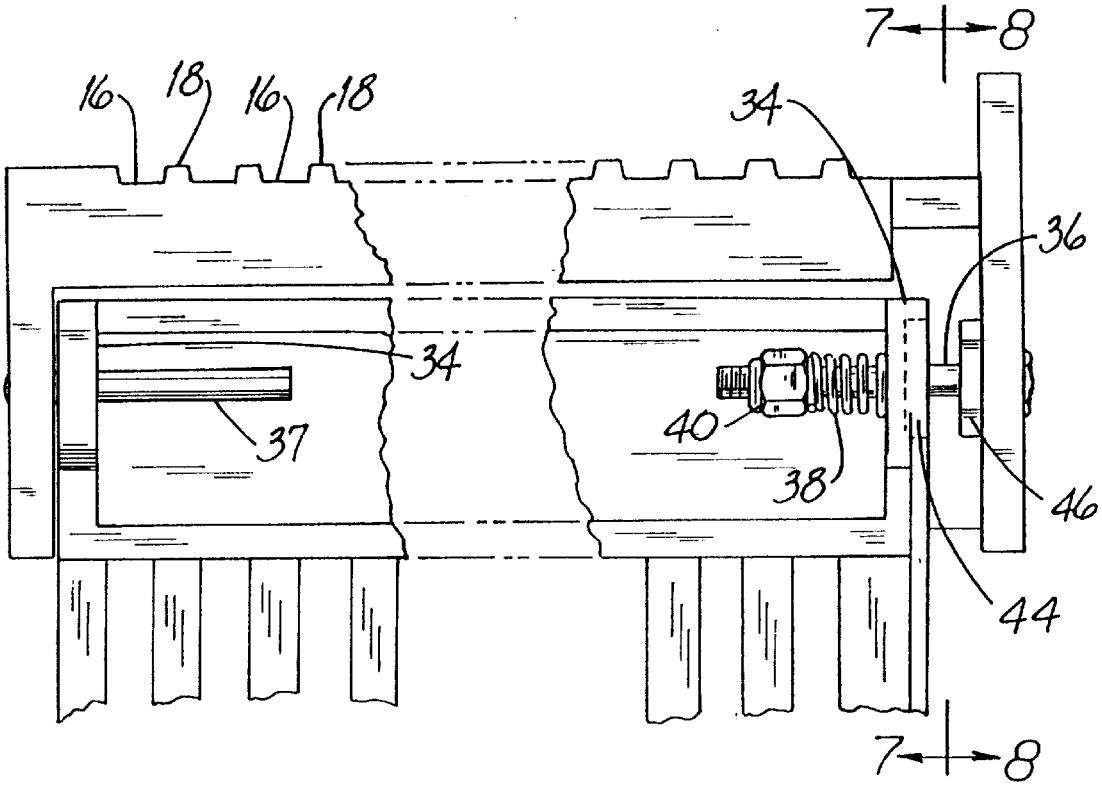
FIG. 6 is a view like that of FIG. 5 and showing the guide member biased longitudinally, releasing the position- retention mechanism. Parts are broken away.
Figure 7:
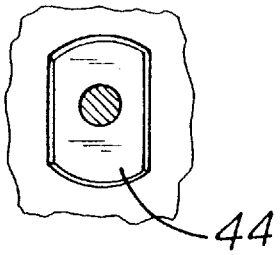
FIG. 7 is a section view taken along the viewing plane 7—7 of FIG. 6 and showing the cavity portion of the position-retention mechanism. Parts are broken away.
Figure 8:
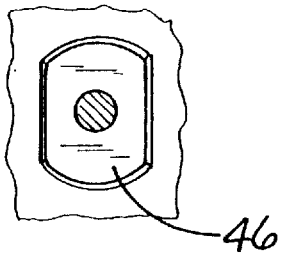
FIG. 8 is a section view taken along the viewing plane 8—8 of FIG. 6 and showing the raised portion of the position-retention mechanism.

Referring particularly to FIGS. 5 and 6, a convenient feature of the new bread slicing guide involves a position-retention mechanism, a separate one of which retains each guide member 24 in either the bread-slicing position or the storage position. In a highly preferred embodiment, each such mechanism includes a cavity 44 and a raised portion 46 with the cavity 44 being in the guide member 24 and the raised portion 46 formed on the support member 20.

The cavity 44 and the raised portion 46 have the same "torque-transmitting" geometric shape which coacts between the base member 12 and the guide member 24. In a specific embodiment, both the cavity 44 and the raised portion 46 resemble an ice hockey rink in shape in that they are generally rectangular and have rounded ends. This is because a rectangular shape only allows the guide members to be locked into positions 180° apart from each other. Of course other geometric shapes, including a diamond, could be used to lock the guides into position 180° apart from each other.

When a guide member 24 is in either the bread-slicing position or the storage position, its biasing spring 38 urges such member in a direction such that the raised portion 46 and the cavity 44 are "nested" to one another to hold the guide member 24 in position. And when the guide member 24 is being pivoted between the bread slicing and storage positions, the raised portion 46 and the cavity 44 are spaced slightly from one another.

To "set up" a guide member 24 at the bread slicing position or to move such member to its storage position, light force is applied to the guide member 24 in a direction generally parallel to the pivot axis and in a direction to further compress the spring 38. Such force application disengages the position-retention mechanism 42 by moving the raised portion 46 and cavity 44 away from one another. In the depicted embodiment, the cavity 44 (formed in the attachment portion 32 of the guide member 24) is moved away from the raised portion 46 so that such portion is out of the cavity 44.

Thereafter, the guide member 24 may be rotated 180 degrees about its pivot axis to be positioned for bread slicing or storage, as the case may be. When applied force is released (as it may be after only slight rotation), the raised portion 46 again nests in the cavity 44 as they become properly aligned.

Figure 9:
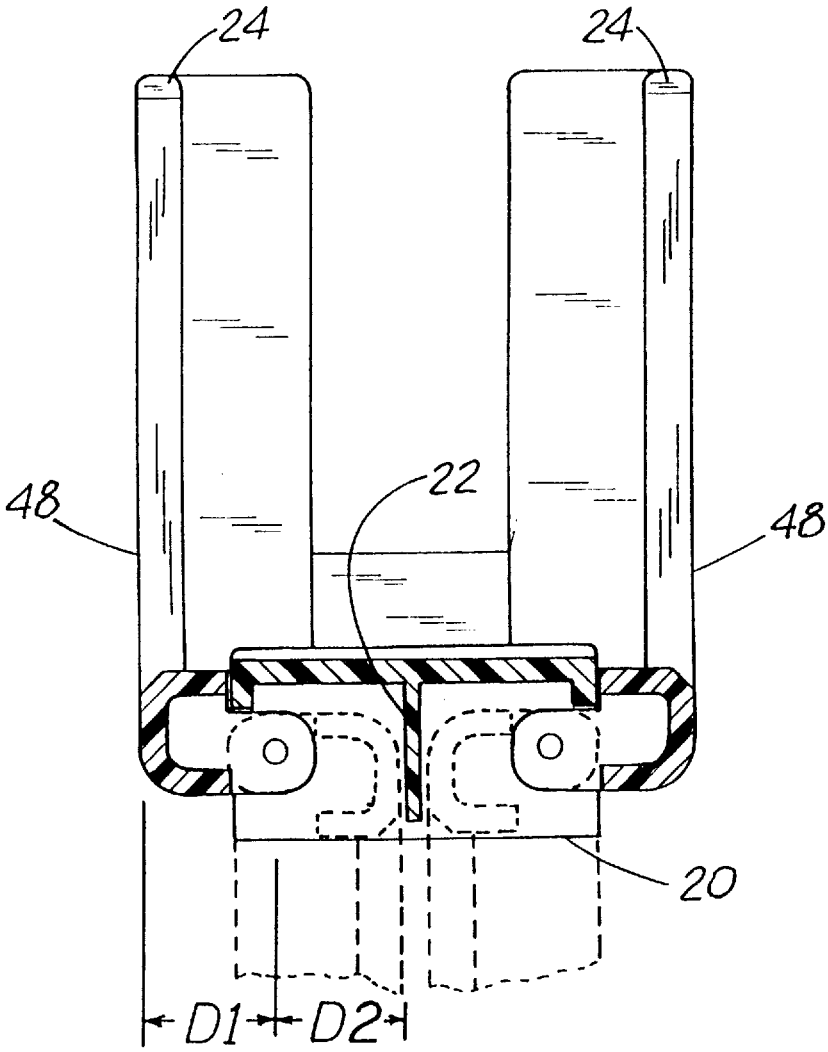
FIG. 9 is a section view taken along the viewing plane 9—9 of FIG. 1. In solid outline, the guide members are shown in the bread slicing position and in dashed outline, the guide members are shown in the storage position. Certain surfaces of parts are shown in dashed outline.

Considering FIG. 9, there is a distance D1 from the outer surface of a guide member sidewall 48 to the pivot axis for that guide member 24 when such guide member 24 is in the upright position for bread slicing as shown in solid outline. And there is a distance D2 from the same sidewall 48 surface to the pivot axis for that guide member 24 when such guide member 24 is folded for storage as shown in dashed outline. In a highly preferred embodiment, the distances D1 and D2 are about equal to one another. And when the guide members 24 are folded for storage, such members abut the reinforcing rib 22 and the sidewall surfaces 48 are substantially aligned with the long center axis of the cutting board 14.

Another aspect of the invention involves a new method for storing a bread slicing guide. Such method includes the steps of providing a bread slicing guide having a base member 12 and a guide member 24 mounted for pivoting movement with respect to the base member 12. A position-retention mechanism, coacting between the base member 12 and the guide member 24, is released and the guide member 24 is pivoted to a storage position beneath the base member 12.

Preferably, the pivoting step includes re-engaging the position-retention mechanism 42, thereby securing the guide member 24 in the storage position. A preferred releasing step includes applying force to the guide member 24 in a direction generally parallel to the pivot axis while another, less-preferred releasing step includes applying force to the guide member 24 in a direction generally coincident with the pivot axis.

The new method is not limited to storing the new guide 10 and may also include one or more steps for setting up such guide 10 preparatory to use. Such set-up step includes pivoting the guide member 24 to a bread-slicing position wherein the sidewall 48 projects above the cutting surface.

As used herein, terms such as "beneath," "under," "above" and the like refer to the new guide 10 positioned so that the cutting surface faces upward.

While the principles of the invention have been shown and described in connection with specific embodiments, it is to be understood clearly that such embodiments are by way of example and are not limiting. For example, the bread slicing guide 10 is preferably substantially entirely made of molded plastic which is resistant to dishwasher environments. However, other materials may be used.

What is claimed:

1. A method for storing a bread slicing guide including the steps of:

providing a bread slicing guide having a base member having a top bread slicing surface for supporting a loaf of bread and having an opposed bottom surface, said bread slicing guide further having a guide member mounted for pivoting movement with respect to the base member, said guide member further having at least one elongate guide element for guiding a cutting knife, said bread slicing guide further having a position retention mechanism for retaining said at least one elongate guide element in an orientation generally perpendicular to and above the bread slicing surface of the base member;

releasing the position-retention mechanism coacting between the base member and the guide member; and pivoting the guide member about 180 degrees to a storage position where the at least one elongate guide element is in an orientation generally perpendicular and below the opposed bottom surface of the base member.

2. The method of claim 1 wherein the pivoting step includes re-engaging the position-retention mechanism, thereby securing the guide member in the storage position.

3. The method of claim 1 wherein the guide member is mounted for pivoting movement about a pivot axis and the releasing step includes applying force to the guide member in a direction generally parallel to the pivot axis.

4. The method of claim 1 wherein the guide member is mounted for pivoting movement about a pivot axis and the releasing step includes applying force to the guide member in a direction generally coincident with the pivot axis.

* * * * *